US010874906B2

(12) United States Patent
Sajima

(10) Patent No.: US 10,874,906 B2
(45) Date of Patent: Dec. 29, 2020

(54) GOLF BALL

(71) Applicant: SUMITOMO RUBBER INDUSTRIES, LTD., Kobe (JP)

(72) Inventor: Takahiro Sajima, Kobe (JP)

(73) Assignee: SUMITOMO RUBBER INDUSTRIES, LTD., Kobe (JP)

( * ) Notice: Subject to any disclaimer, the term of this patent is extended or adjusted under 35 U.S.C. 154(b) by 0 days.

(21) Appl. No.: 16/202,820

(22) Filed: Nov. 28, 2018

(65) Prior Publication Data

US 2019/0192917 A1 Jun. 27, 2019

(30) Foreign Application Priority Data

Dec. 22, 2017 (JP) ..... 2017-245691

(51) Int. Cl.
*A63B 37/12* (2006.01)
*A63B 37/00* (2006.01)
*A63B 102/32* (2015.01)

(52) U.S. Cl.
CPC ..... *A63B 37/0012* (2013.01); *A63B 37/0005* (2013.01); *A63B 37/0015* (2013.01); *A63B 37/0019* (2013.01); *A63B 37/0021* (2013.01); *A63B 37/0022* (2013.01); *A63B 37/0006* (2013.01); *A63B 37/0073* (2013.01); *A63B 37/0074* (2013.01); *A63B 37/0075* (2013.01); *A63B 37/0076* (2013.01); *A63B 2102/32* (2015.10)

(58) Field of Classification Search
CPC ..... A63B 37/0005; A63B 37/0004
USPC ..... 473/378
See application file for complete search history.

(56) References Cited

U.S. PATENT DOCUMENTS 5,916,044 A * 6/1999 Shimosaka ..... A63B 37/0004 473/377
6,626,772 B1 * 9/2003 Kennedy, III ..... A63B 37/0004 473/384
8,894,509 B2 * 11/2014 Kim ..... A63B 37/0004 473/373
2005/0037871 A1 * 2/2005 Nardacci ..... A63B 37/0021 473/378
2011/0077106 A1 3/2011 Fitchett
(Continued)

FOREIGN PATENT DOCUMENTS

JP 2-68077 A 3/1990
JP 2011-72776 A 4/2011
JP 2015-142599 A 8/2015

*Primary Examiner* — Raeann Gorden
(74) *Attorney, Agent, or Firm* — Birch, Stewart, Kolasch & Birch, LLP

(57) ABSTRACT

A golf ball has a plurality of dimples 12 and a land 14 on a surface thereof. The golf ball further has a large number of minute projections 18 formed on surfaces of the dimples 12 and the land 14. An average depth Fav of the dimples 12 and an average height Hav of the minute projections satisfy the following mathematical formula (1).

$$Hav/Fav \geq 0.050 \quad (1)$$

A ratio M (%) of a sum of areas of all the dimples 12 relative to a surface area of a phantom sphere of the golf ball and an average value Pav (μm) of pitches P each between a minute projection 18 and another minute projection 18 adjacent to this minute projection 18 satisfy the following mathematical formula (2).

$$M/Pav > 0.3 \quad (2)$$

6 Claims, 6 Drawing Sheets

(56) References Cited

U.S. PATENT DOCUMENTS

| | | | | |
|---|---|---|---|---|
| 2011/0195802 | A1* | 8/2011 | Nakamura | A63B 37/0004 473/384 |
| 2015/0182805 | A1 | 7/2015 | Sajima et al. | |
| 2015/0375058 | A1* | 12/2015 | Kamino | A63B 37/0077 473/374 |
| 2016/0067552 | A1* | 3/2016 | Hixenbaugh | A63B 37/0015 473/383 |
| 2016/0339302 | A1* | 11/2016 | Nardacci | A63B 37/0015 |
| 2018/0056136 | A1* | 3/2018 | Mimura | A63B 37/0005 |
| 2018/0056138 | A1* | 3/2018 | Sajima | A63B 37/0075 |

* cited by examiner

GOLF BALL

This application claims priority on Patent Application No. 2017-245691 filed in JAPAN on Dec. 22, 2017. The entire contents of this Japanese Patent Application are hereby incorporated by reference.

BACKGROUND OF THE INVENTION

Field of the Invention

The present invention relates to golf balls. Specifically, the present invention relates to golf balls having dimples on the surfaces thereof.

Description of the Related Art

Golf balls have a large number of dimples on the surfaces thereof. The dimples disturb the air flow around the golf ball during flight to cause turbulent flow separation. This phenomenon is referred to as "turbulization". Due to the turbulization, separation points of the air from the golf ball shift backwards leading to a reduction of drag. The turbulization promotes the displacement between the separation point on the upper side and the separation point on the lower side of the golf ball, which results from the backspin, thereby enhancing the lift force that acts upon the golf ball. The reduction of drag and the enhancement of lift force are referred to as a "dimple effect". Excellent dimples efficiently disturb the air flow. The excellent dimples produce a long flight distance.

A flight distance of a golf ball is the total of a carry and a run. The carry is the distance from the launch point to the landing point. The run is the distance from the landing point to the stop point. Upon a shot with a short iron, a large carry and a small run are desired. This is because golf players place importance on causing a golf ball to stop at a target point upon a shot with a short iron. Meanwhile, upon a shot with a driver, a large carry and a large run are desired. This is because golf players desire to make a golf ball as close to the pin as possible upon a shot with a driver.

The depths of dimples influence the aerodynamic characteristic of a golf ball. Deep dimples reduce the lift force that acts upon a golf ball. A trajectory of a golf ball having deep dimples is low. Therefore, with this golf ball, a large run is obtained. However, a carry of this golf ball is not sufficient. There is room for improvement in the flight distance (total) of this golf ball.

JP2015-142599 discloses a golf ball having a surface with large roughness. The roughness can be formed by blasting or the like. The roughness enhances the aerodynamic characteristic of the golf ball due to a synergetic effect with dimples.

JP2011-72776 discloses a golf ball having a coating formed from a paint that contains particles. The particles enhance the aerodynamic characteristic of the golf ball due to a synergetic effect with dimples.

JPH2-68077 discloses a golf ball having dimples each having one projection at a bottom thereof. The dimples each having the projection enhance the aerodynamic characteristic of the golf ball.

The greatest interest to golf players concerning golf balls is flight distance. Golf players desire golf balls having excellent flight performance. In particular, golf players desire a large flight distance (total) upon a shot with a driver.

An object of the present invention is to provide a golf ball having excellent flight performance upon a shot with a driver.

SUMMARY OF THE INVENTION

A golf ball according to the present invention has a plurality of dimples and a land. The golf ball further has a large number of minute projections formed on surfaces of the dimples and/or the land. An average depth Fav of the dimples and an average height Hav of the minute projections satisfy the following mathematical formula (1).

$$Hav/Fav \geq 0.050 \quad (1)$$

With the golf ball according to the present invention, the minute projections reduce lift force of the golf ball during flight. A trajectory of the golf ball is not excessively high. Therefore, with the golf ball, a large run is obtained. The minute projections also reduce drag of the golf ball during flight. Therefore, with the golf ball, as compared to a conventional golf ball, a carry is not significantly reduced. With the golf ball, a large total flight distance can be obtained.

Preferably, a ratio M (%) of a sum of areas of all the dimples relative to a surface area of a phantom sphere of the golf ball and an average value Pav (μm) of pitches P each between a minute projection and another minute projection adjacent to this minute projection satisfy the following mathematical formula (2).

$$M/Pav > 0.3 \quad (2)$$

Preferably, an average value Pav of pitches P, and an average value Lav of distances L, each between a minute projection and another minute projection adjacent to this minute projection, satisfy the following mathematical formula (3).

$$Lav/Pav < 0.9 \quad (3)$$

Preferably, an average value Pav of pitches P each between a minute projection and another minute projection adjacent to this minute projection is not greater than 200 μm.

The golf ball may have a plurality of rows of minute projections. Preferably, in each row, a plurality of the minute projections are aligned at equal pitches.

The golf ball may include a main body and a paint layer positioned outside the main body. Preferably, each minute projection has a shape in which a surface shape of the main body is reflected.

DESCRIPTION OF THE PREFERRED EMBODIMENTS

The following will describe in detail the present invention based on preferred embodiments with appropriate reference to the drawings.

Figure 1:
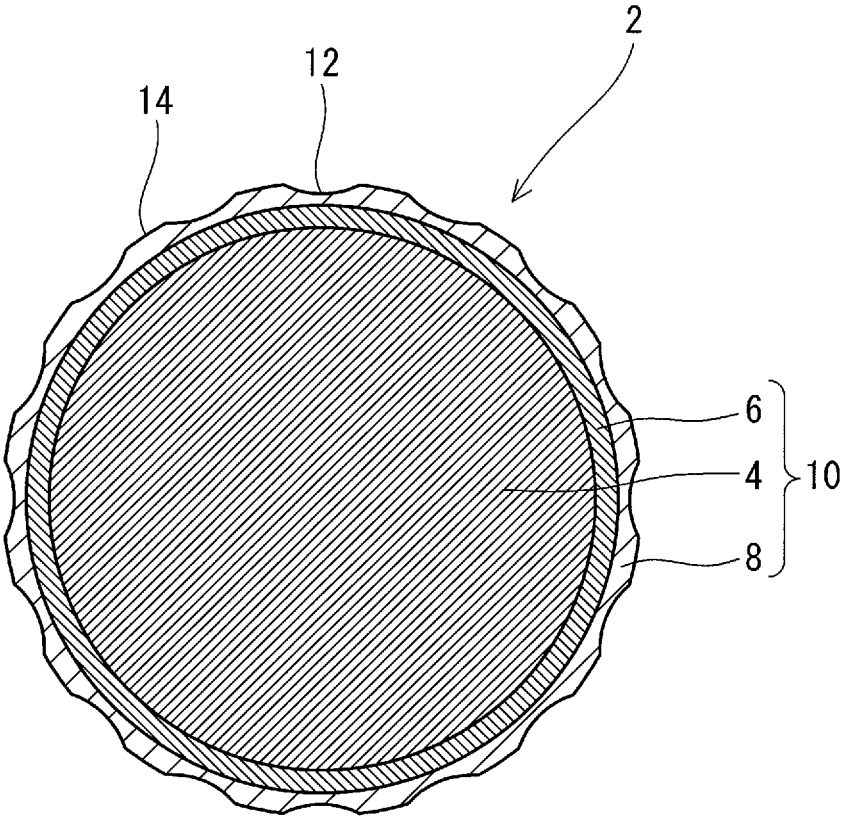
FIG. 1 is a cross-sectional view of a golf ball according to an embodiment of the present invention.

A golf ball 2 shown in FIG. 1 includes a spherical core 4, a mid layer 6 positioned outside the core 4, and a cover 8 positioned outside the mid layer 6. The core 4, the mid layer 6, and the cover 8 are included in a main body 10 of the golf ball 2. The golf ball 2 has a large number of dimples 12 on the surface thereof. Of the surface of the golf ball 2, a part other than the dimples 12 is a land 14. Although not shown in FIG. 1, the golf ball 2 further includes a later-described paint layer. The paint layer is positioned outside the main body 10. The main body 10 may have a one-piece structure, a two-piece structure, a four-piece structure, a five-piece structure, or the like.

The golf ball 2 preferably has a diameter of not less than 40 mm and not greater than 45 mm. From the viewpoint of conformity to the rules established by the United States Golf Association (USGA), the diameter is particularly preferably not less than 42.67 mm. In light of suppression of air resistance, the diameter is more preferably not greater than 44 mm and particularly preferably not greater than 42.80 mm. The diameter of the golf ball 2 according to the present embodiment is 42.7 mm.

The golf ball 2 preferably has a weight of not less than 40 g and not greater than 50 g. In light of attainment of great inertia, the weight is more preferably not less than 44 g and particularly preferably not less than 45.00 g. From the viewpoint of conformity to the rules established by the USGA, the weight is particularly preferably not greater than 45.93 g.

The core 4 is formed by crosslinking a rubber composition. Examples of the base rubber of the rubber composition include polybutadienes, polyisoprenes, styrene-butadiene copolymers, ethylene-propylene-diene copolymers, and natural rubbers. Two or more rubbers may be used in combination. In light of resilience performance, polybutadienes are preferable, and high-cis polybutadienes are particularly preferable.

The rubber composition of the core 4 includes a co-crosslinking agent. Examples of preferable co-crosslinking agents in light of resilience performance include zinc acrylate, magnesium acrylate, zinc methacrylate, and magnesium methacrylate. The rubber composition preferably includes an organic peroxide together with a co-crosslinking agent. Examples of preferable organic peroxides include dicumyl peroxide, 1,1-bis(t-butylperoxy)-3,3,5-trimethylcyclohexane, 2,5-dimethyl-2,5-di(t-butylperoxy)hexane, and di-t-butyl peroxide.

The rubber composition of the core 4 may include additives such as a filler, sulfur, a vulcanization accelerator, a sulfur compound, an anti-aging agent, a coloring agent, a plasticizer, and a dispersant. The rubber composition may include a carboxylic acid or a carboxylate. The rubber composition may include synthetic resin powder or cross-linked rubber powder.

The core 4 has a diameter of preferably not less than 30.0 mm and particularly preferably not less than 38.0 mm. The diameter of the core 4 is preferably not greater than 42.0 mm and particularly preferably not greater than 41.5 mm. The core 4 may have two or more layers. The core 4 may have a rib on the surface thereof. The core 4 may be hollow.

The mid layer 6 is formed from a resin composition. A preferable base polymer of the resin composition is an ionomer resin. Examples of preferable ionomer resins include binary copolymers formed with an α-olefin and an α,β-unsaturated carboxylic acid having 3 to 8 carbon atoms. Examples of other preferable ionomer resins include ternary copolymers formed with: an α-olefin; an α,β-unsaturated carboxylic acid having 3 to 8 carbon atoms; and an α,β-unsaturated carboxylate ester having 2 to 22 carbon atoms. For the binary copolymer and the ternary copolymer, preferable α-olefins are ethylene and propylene, while preferable α,βunsaturated carboxylic acids are acrylic acid and methacrylic acid. In the binary copolymer and the ternary copolymer, some of the carboxyl groups are neutralized with metal ions. Examples of metal ions for use in neutralization include sodium ion, potassium ion, lithium ion, zinc ion, calcium ion, magnesium ion, aluminum ion, and neodymium ion.

Instead of an ionomer resin or together with an ionomer resin, the resin composition of the mid layer 6 may include another polymer. Examples of the other polymer include polystyrenes, polyamides, polyesters, polyolefins, and polyurethanes. The resin composition may include two or more polymers.

The resin composition of the mid layer 6 may include a coloring agent such as titanium dioxide, a filler such as barium sulfate, a dispersant, an antioxidant, an ultraviolet absorber, a light stabilizer, a fluorescent material, a fluorescent brightener, and the like. For the purpose of adjusting specific gravity, the resin composition may include powder of a metal with a high specific gravity such as tungsten, molybdenum, and the like.

The mid layer 6 has a thickness of preferably not less than 0.2 mm and particularly preferably not less than 0.3 mm. The thickness of the mid layer 6 is preferably not greater than 2.5 mm and particularly preferably not greater than 2.2 mm. The mid layer 6 has a specific gravity of preferably not less than 0.90 and particularly preferably not less than 0.95. The specific gravity of the mid layer 6 is preferably not greater than 1.10 and particularly preferably not greater than 1.05. The mid layer 6 may have two or more layers.

The cover 8 is formed from a thermoplastic resin composition. Examples of the base polymer of the resin composition include ionomer resins, thermoplastic polyester elastomers, thermoplastic polyamide elastomers, thermoplastic polyurethane elastomers, thermoplastic polyolefin elastomers, and thermoplastic polystyrene elastomers. Ionomer resins are particularly preferable. Ionomer resins are highly elastic. The golf ball 2 having the cover 8 that includes an ionomer resin has excellent resilience performance. The golf ball 2 has excellent flight distance upon a shot with a driver. The ionomer resin described above for the mid layer 6 can be used for the cover 8.

An ionomer resin and another resin may be used in combination. In this case, in light of resilience performance, the ionomer resin is included as the principal component of the base polymer. The proportion of the ionomer resin to the entire base polymer is preferably not less than 50% by weight, more preferably not less than 70% by weight, and particularly preferably not less than 80% by weight.

The resin composition of the cover 8 may include a coloring agent, a filler, a dispersant, an antioxidant, an ultraviolet absorber, a light stabilizer, a fluorescent material, a fluorescent brightener, and the like in an adequate amount. When the hue of the golf ball 2 is white, a typical coloring agent is titanium dioxide.

The cover 8 has a thickness of preferably not less than 0.2 mm and particularly preferably not less than 0.3 mm. The thickness of the cover 8 is preferably not greater than 2.5 mm and particularly preferably not greater than 2.2 mm. The cover 8 has a specific gravity of preferably not less than 0.90 and particularly preferably not less than 0.95. The specific gravity of the cover 8 is preferably not greater than 1.10 and particularly preferably not greater than 1.05. The cover 8 may have two or more layers.

Figure 2:
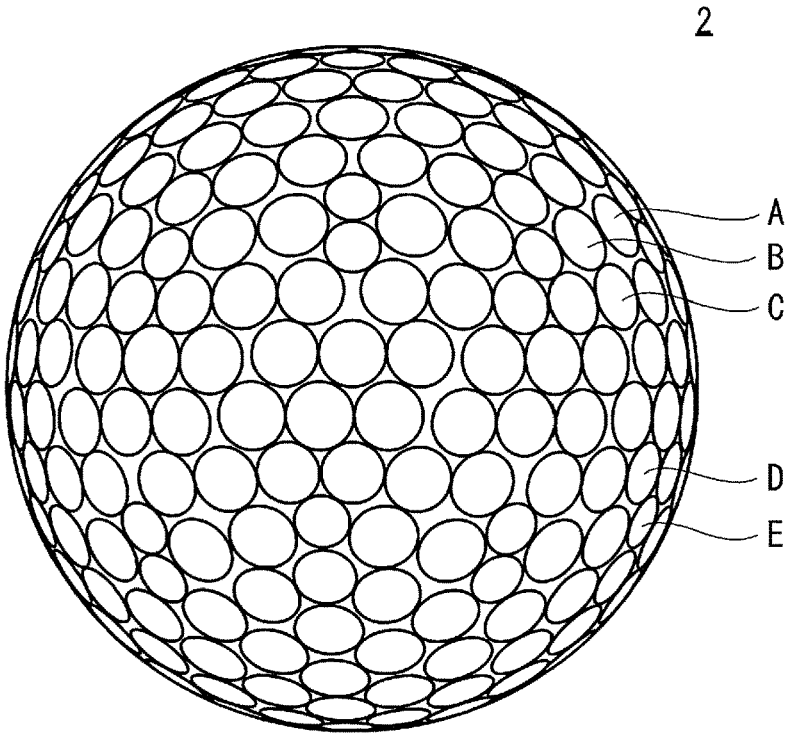
FIG. 2 is an enlarged front view of the golf ball in FIG. 1.
Figure 3:
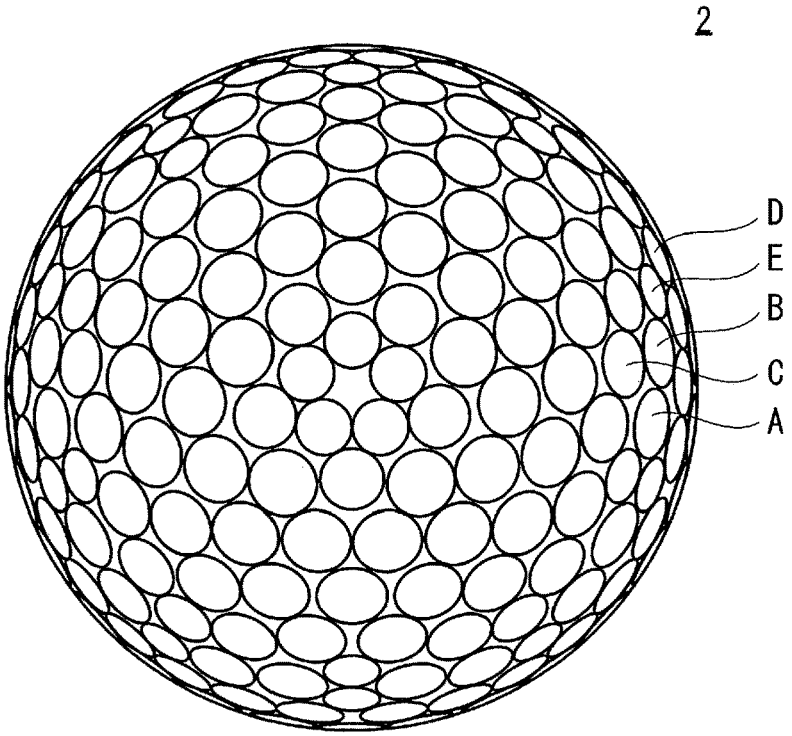
FIG. 3 is a plan view of the golf ball in FIG. 2.

FIG. 2 is an enlarged front view of the golf ball 2 in FIG. 1, and FIG. 3 is a plan view of the golf ball 2. As described above, the golf ball 2 has a large number of the dimples 12 on the surface thereof. The contour of each dimple 12 is circular. The golf ball 2 has dimples A each having a diameter of 4.40 mm; dimples B each having a diameter of 4.30 mm; dimples C each having a diameter of 4.20 mm; dimples D each having a diameter of 3.95 mm; and dimples E each having a diameter of 3.50 mm. The number of types of the dimples 12 is five. The golf ball 2 may have non-circular dimples instead of the circular dimples 12 or together with circular dimples 12.

The number of the dimples A is 30; the number of the dimples B is 140; the number of the dimples C is 90; the number of the dimples D is 40; and the number of the dimples E is 40. The total number of the dimples 12 is 340. A dimple pattern is formed by these dimples 12 and the land 14.

Figure 4:
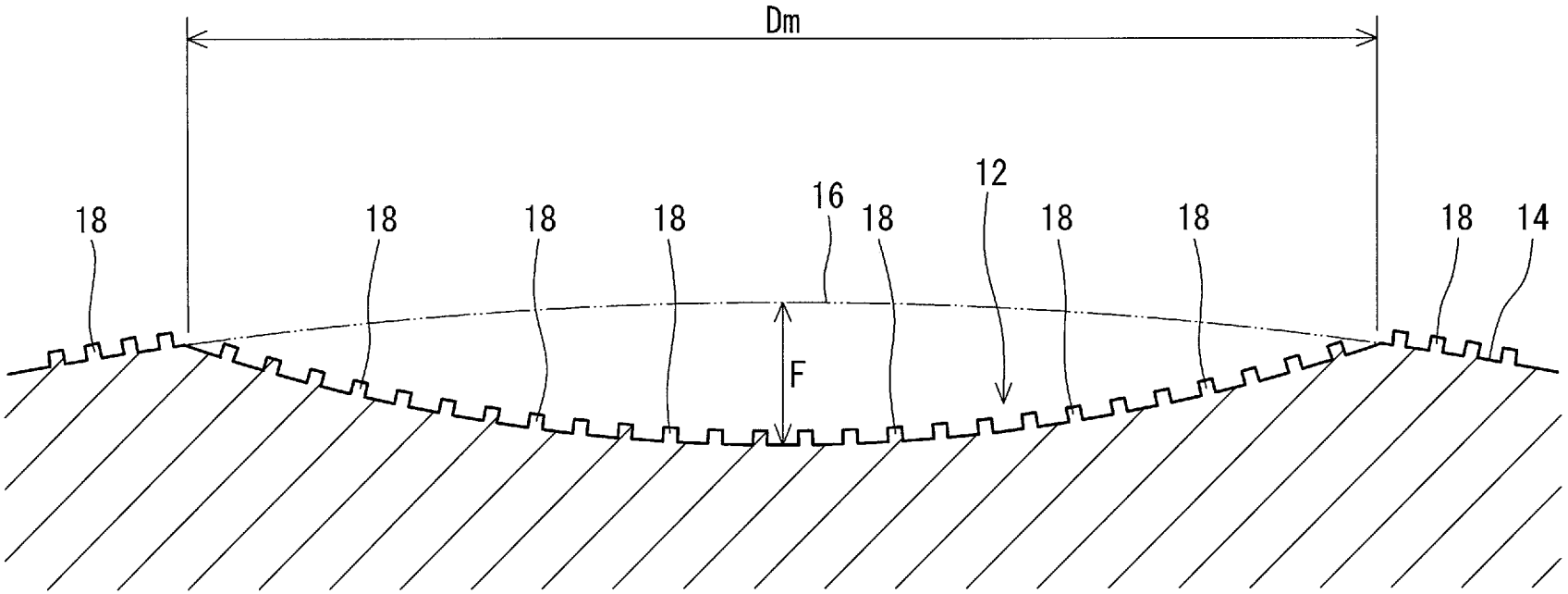
FIG. 4 is a partially enlarged cross-sectional view of the golf ball in FIG. 1.

FIG. 4 shows a cross section of the golf ball 2 along a plane passing through the central point of the dimple 12 and the central point of the golf ball 2. In FIG. 4, the top-to-bottom direction is the depth direction of the dimple 12. In FIG. 4, an alternate long and two short dashes line 16 indicates a phantom sphere. The surface of the phantom sphere 16 is the surface of the golf ball 2 when it is postulated that no dimple 12 and no minute projection 18 (described in detail later) exist. The diameter of the phantom sphere 16 is equal to the diameter of the golf ball 2. The dimple 12 is recessed from the surface of the phantom sphere 16. The land 14 coincides with the surface of the phantom sphere 16.

In FIG. 4, an arrow Dm indicates the diameter of the dimple 12. The diameter Dm is the distance between two tangent points Ed appearing on a tangent line Tg that is drawn tangent to the far opposite ends of the dimple 12. Each tangent point Ed is also the edge of the dimple 12. The edge Ed defines the contour of the dimple 12.

The diameter Dm of each dimple 12 is preferably not less than 2.0 mm and not greater than 6.0 mm. The dimple 12 having a diameter Dm of not less than 2.0 mm contributes to turbulization. From this viewpoint, the diameter Dm is more preferably not less than 2.5 mm and particularly preferably not less than 2.8 mm. The dimple 12 having a diameter Dm of not greater than 6.0 mm does not impair a fundamental feature of the golf ball 2 being substantially a sphere. From this viewpoint, the diameter Dm is more preferably not greater than 5.5 mm and particularly preferably not greater than 5.0 mm.

In the case of a non-circular dimple, a circular dimple 12 having the same area as that of the non-circular dimple is assumed. The diameter of the assumed dimple 12 can be regarded as the diameter of the non-circular dimple.

In FIG. 4, a double ended arrow F indicates the depth of the dimple 12. The depth F is the distance between the deepest part of the dimple 12 and the surface of the phantom sphere 16. An average depth Fav is calculated by summing the depths F of all the dimples 12 and dividing the sum of the depths F by the total number of the dimples 12. The average depth Fav is preferably not less than 200 μm and not greater than 300 μm. With the golf ball 2 in which the average depth Fav is not less than 200 μm, a large run can be achieved. From this viewpoint, the average depth Fav is more preferably not less than 205 μm and particularly preferably not less than 210 μm. With the golf ball 2 in which the average depth Fav is not greater than 300 μm, a large carry can be achieved. From this viewpoint, the average depth Fav is more preferably not greater than 295 μm and particularly preferably not greater than 290 μm.

The area S of the dimple 12 is the area of a region surrounded by the contour line of the dimple 12 when the central point of the golf ball 2 is viewed at infinity. In the case of a circular dimple 12, the area S is calculated by the following mathematical formula.

$$S=(Dm/2)^2*n$$

In the golf ball 2 according to the present embodiment, the area of each dimple A is 15.20 $mm^2$; the area of each dimple B is 14.52 $mm^2$; the area of each dimple C is 13.85 $mm^2$; the area of each dimple D is 12.25 $mm^2$; and the area of each dimple E is 9.62 $mm^2$.

In the present invention, the ratio of the sum of the areas S of all the dimples 12 relative to the surface area of the phantom sphere 16 is referred to as an occupation ratio M. From the viewpoint of achieving sufficient turbulization, the occupation ratio M is preferably not less than 70.0%, more preferably not less than 75.0%, and particularly preferably not less than 80.0%. The occupation ratio M is preferably not greater than 95%. In the golf ball 2 according to the present embodiment, the total area of the dimples 12 is 4611.0 $mm^2$. The surface area of the phantom sphere 16 of the golf ball 2 is 5728.0 $mm^2$, so that the occupation ratio M is 80.5%.

From the viewpoint of achieving a sufficient occupation ratio M, the total number N of the dimples 12 is preferably not less than 250, more preferably not less than 280, and particularly preferably not less than 300. From the viewpoint that each dimple 12 can contribute to turbulization, the total number N is preferably not greater than 500, more preferably not greater than 450, and particularly preferably not greater than 400.

In the present invention, the "volume of the dimple" means the volume of a portion surrounded by the surface of the phantom sphere 16 and the surface of the dimple 12. From the viewpoint that a large run can be achieved, the total volume of the dimples 12 is preferably not less than 450 $mm^3$, more preferably not less than 470 $mm^3$, and particularly preferably not less than 490 $mm^3$. From the viewpoint that a large carry can be achieved, the total volume is preferably not greater than 630 $mm^3$, more preferably not greater than 610 $mm^3$, and particularly preferably not greater than 600 $mm^3$.

Figure 5:
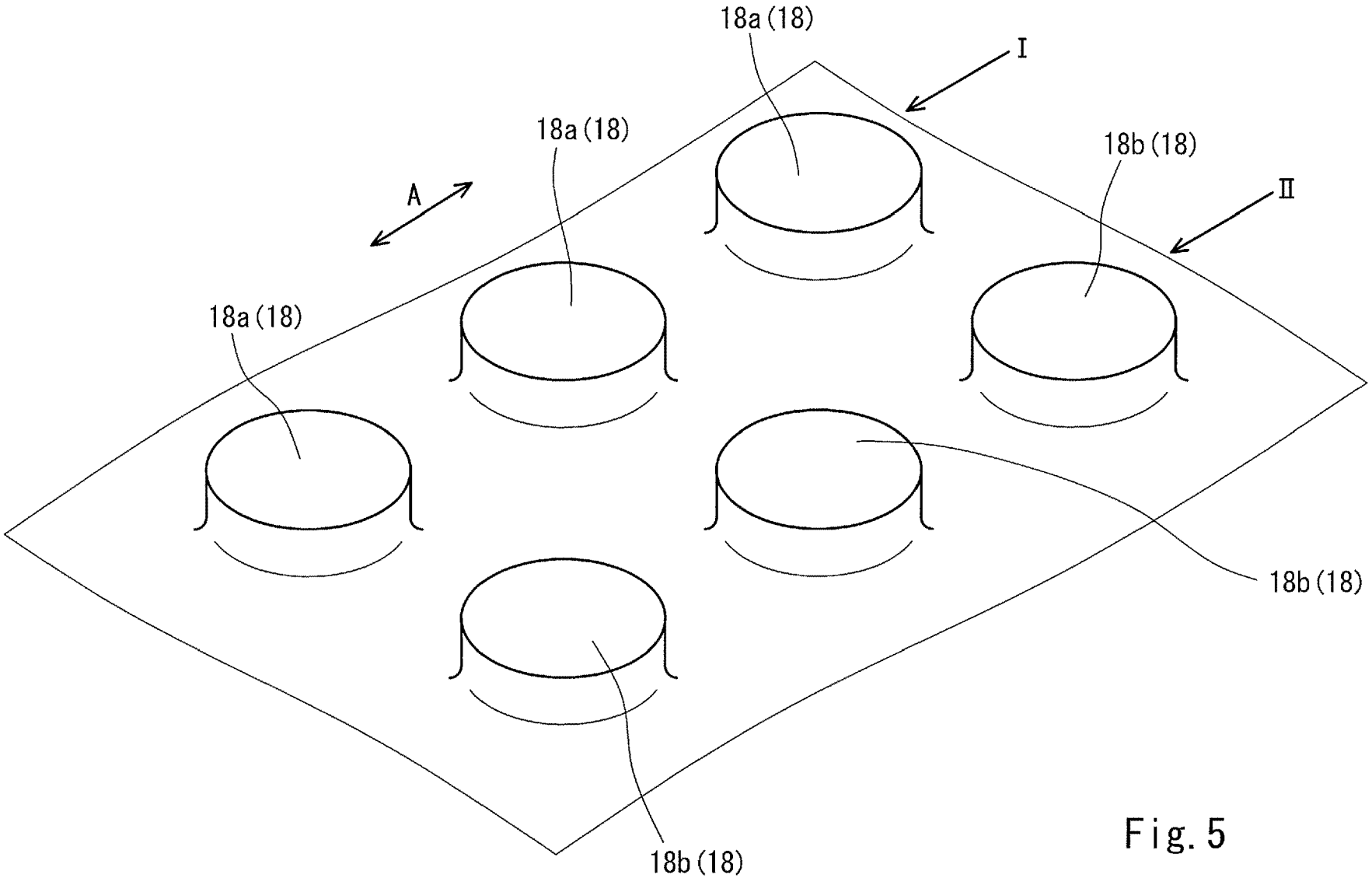
FIG. 5 is a partially enlarged perspective view of the surface of the golf ball in FIG. 1.

FIG. 5 is a partially enlarged perspective view of the surface of the golf ball 2 in FIG. 1. As is obvious from FIG. 5, the golf ball 2 has a large number of minute projections 18 on the surface thereof. As is obvious from FIG. 4, the minute projections 18 are formed on the surfaces of the dimples 12 and also on the surface of the land 14. Each minute projection 18 stands outward in the radial direction of the golf ball 2. The minute projections 18 may be formed only on the surfaces of the dimples 12. The minute projections 18 may be formed only on the surface of the land 14.

The minute projections 18 reduce lift force and drag of the golf ball 2 during flight. Owing to the reduction of lift force, a large run can be achieved. Owing to the reduction of drag, a large carry can be achieved. The golf ball 2 has excellent flight performance upon a shot with a driver.

FIG. 5 shows three minute projections 18 *a* belonging to a first row I, and three minute projections 18*b* belonging to a second row II. The direction indicated by an arrow A in FIG. 5 is the direction in which the rows extend. In each row, the minute projections 18 are aligned at equal pitches. In other words, the minute projections 18 are regularly aligned. At a part of the surface of the golf ball 2, the minute projections 18 may be irregularly aligned.

The minute projections 18 *a*, which belong to the first row I, and the minute projections 18*b*, which belong to the second row II, may be arranged in a zigzag manner. In other words, the positions of the minute projections 18 *a*, which belong to the first row I, may be displaced relative to the positions of the minute projections 18*b*, which belong to the second row II, in the extending direction A.

Figure 6:
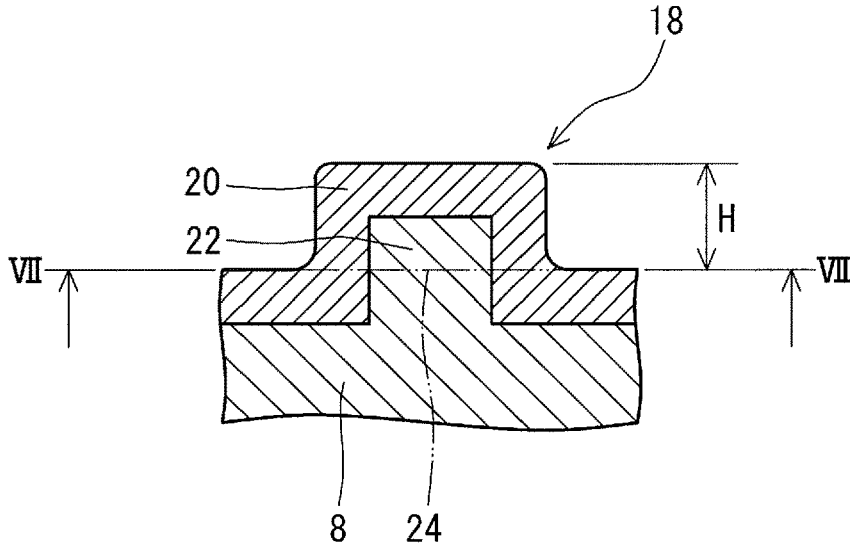
FIG. 6 is a partially enlarged cross-sectional view of the golf ball in FIG. 1.

FIG. 6 is a partially enlarged cross-sectional view of the golf ball 2 in FIG. 1. FIG. 6 shows the cover 8, which is a part of the main body 10, and a paint layer 20. FIG. 6 shows the minute projection 18. The cover 8 has a projection portion 22. The minute projection 18 is formed by the projection portion 22 and the paint layer 20. The projection portion 22 stands outward in the radial direction of the golf ball 2 (upward in FIG. 6). Thus, the minute projection 18 also stands outward in the radial direction of the golf ball 2. In other words, the minute projection 18 has a shape in which the surface shape of the main body 10 (cover 8) is reflected. In FIG. 6, reference sign 24 indicates the bottom surface of the minute projection 18.

Figure 7:
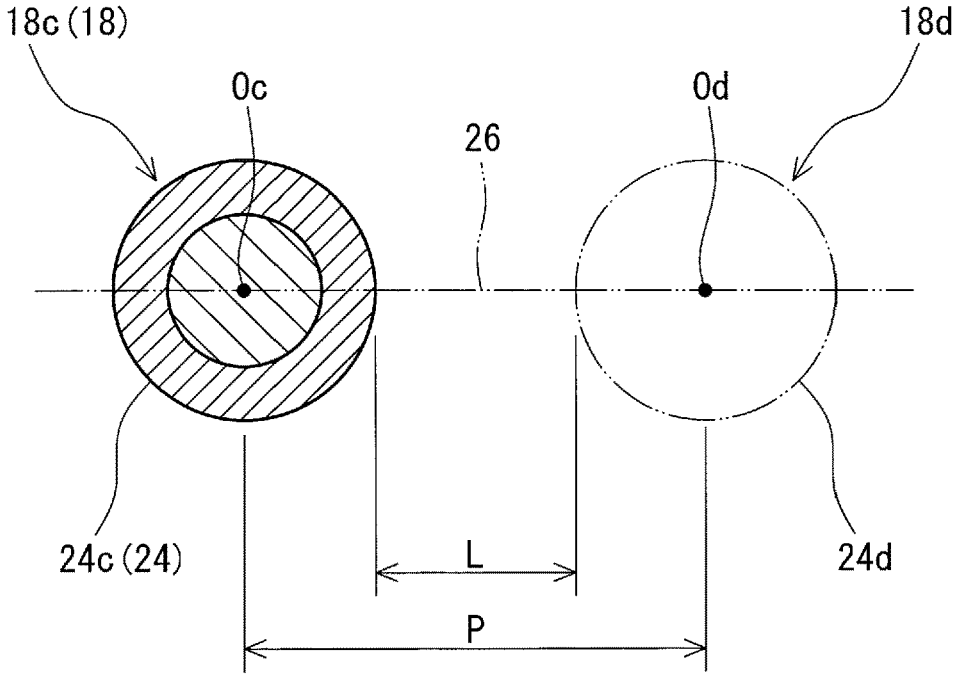
FIG. 7 is a cross-sectional view taken along the line VII-VII in FIG. 6.

FIG. 7 is a cross-sectional view taken along the line VII-VII in FIG. 6. FIG. 7 shows the bottom surface 24 of the minute projection 18. The bottom surface 24 includes the cover 8 and the paint layer 20.

FIG. 7 shows a bottom surface 24*c* of a first minute projection 18*c* and also shows a bottom surface 24*d* of a second minute projection 18*d* by an alternate long and two short dashes line. The second minute projection 18*d* is adjacent to the first minute projection 18*c*. In FIG. 7, an alternate long and two short dashes line 26 represents a straight line passing through the center of gravity Oc of the bottom surface 24*c* of the first minute projection 18*c* and the center of gravity Od of the bottom surface 24*d* of the second minute projection 18*d*.

In FIG. 7, an arrow P indicates a pitch. The pitch P is the distance between the first minute projection 18*c* and the second minute projection 18*d* adjacent to the first minute projection 18*c*. The pitch P is the distance between the center of gravity Oc of the bottom surface 24*c* of the first minute projection 18*c* and the center of gravity Od of the bottom surface 24*d* of the second minute projection 18*d*. The "second minute projection 18*d* adjacent to the first minute projection 18*c*" is the minute projection 18*d* having a smallest distance L (described in detail later) to the first minute projection 18*c*, among the minute projections 18 present around the first minute projection 18*c*.

For each minute projection 18, one pitch P is determined. An average pitch Pav is calculated by summing the pitches P of all the minute projections 18 and dividing the sum of the pitches P by the number of the minute projections 18. The average pitch Pav is preferably not less than 1 μm and not greater than 200 μm. With the golf ball 2 in which the average pitch Pav is not less than 1 μm, the minute projections 18 do not excessively reduce lift force. With the golf ball 2, a large carry can be achieved. From this viewpoint, the average pitch Pav is more preferably not less than 5 μm and particularly preferably not less than 10 μm. With the golf ball 2 in which the average pitch Pav is not greater than 200 μm, the minute projections 18 reduce lift force and drag. With the golf ball 2, a large carry and a large run can be achieved. From this viewpoint, the average pitch Pav is more preferably not greater than 150 μm and particularly preferably not greater than 100 μm.

In FIG. 7, an arrow L indicates the distance between the first minute projection 18*c* and the second minute projection 18*d* adjacent to the first minute projection 18*c*. The distance L is a value obtained by subtracting the radius of the bottom surface 24*c* of the first minute projection 18*c* and the radius of the bottom surface 24*d* of the second minute projection 18*d* from the pitch P. For each minute projection 18, one distance L is determined. An average distance Lav is calculated by summing the distances L of all the minute projections 18 and dividing the sum of the distances L by the number of the minute projections 18. The average distance Lav is preferably not less than 0.1 μm and not greater than 180 μm. With the golf ball 2 in which the average distance Lav is not less than 0.1 μm, the minute projections 18 do not excessively reduce lift force. With the golf ball 2, a large carry can be achieved. From this viewpoint, the average distance Lav is more preferably not less than 1 μm and particularly preferably not less than 3 μm. With the golf ball 2 in which the average distance Lav is not greater than 180 μm, the minute projections 18 reduce lift force and drag. With the golf ball 2, a large carry and a large run can be achieved. From this viewpoint, the average distance Lav is more preferably not greater than 120 μm and particularly preferably not greater than 70 μm.

In FIG. 6, an arrow H indicates the height of the minute projection 18. The height H is measured along the radial direction of the golf ball 2. An average height Hav is calculated by summing the heights H of all the minute projections 18 and dividing the sum of the heights H by the number of the minute projections 18. The average height Hav is preferably not less than 8 μm and not greater than 50 μm. With the golf ball 2 in which the average height Hav is not less than 8 μm, the minute projections 18 reduce lift force and drag. With the golf ball 2, a large carry and a large run can be achieved. From this viewpoint, the average height Hav is more preferably not less than 9 μm and particularly preferably not less than 10 μm. With the golf ball 2 in which the average height Hav is not greater than 50 μm, the minute projections 18 do not excessively reduce lift force. With the golf ball 2, a large carry can be achieved. From this viewpoint, the average height Hav is more preferably not greater than 45 μm and particularly preferably not greater than 40 μm.

An average area Qav is calculated by summing the areas Q of the bottom surfaces 24 of all the minute projections 18 and dividing the sum of the areas Q by the number of the minute projections 18. The average area Qav is preferably not less than 1 $\mu m^2$ and not greater than 35000 $\mu m^2$. With the golf ball 2 in which the average area Qav is not less than 1 $\mu m^2$, the minute projections 18 reduce lift force and drag. With the golf ball 2, a large carry and a large run can be achieved. From this viewpoint, the average area Qav is more preferably not less than 10 $\mu m^2$ and particularly preferably not less than 20 $\mu m^2$. With the golf ball 2 in which the average area Qav is not greater than 35000 $\mu m^2$, the minute projections 18 do not excessively reduce lift force. With the golf ball 2, a large carry can be achieved. From this viewpoint, the average area Qav is more preferably not greater than 30000 $\mu m^2$ and particularly preferably not greater than 25000 $\mu m^2$.

The ratio of the sum of the areas Q of the bottom surfaces 24 of all the minute projections 18 relative to the surface area of the phantom sphere 16 is preferably not less than 5% and not greater than 80%. With the golf ball 2 in which this ratio is not less than 5%, the minute projections 18 reduce lift force and drag. With the golf ball 2, a large carry and a large run can be achieved. From this viewpoint, this ratio is more preferably not less than 15% and particularly preferably not less than 20%. With the golf ball 2 in which this ratio is not greater than 80%, the minute projections 18 do not excessively reduce lift force. With the golf ball 2, a large carry can be achieved. From this viewpoint, this ratio is more preferably not greater than 60% and particularly preferably not greater than 50%.

The total number of the minute projections 18 is preferably not less than 100 thousand and not greater than 10 million. With the golf ball 2 in which this total number is not less than 100 thousand, the minute projections 18 reduce lift force and drag. With the golf ball 2, a large carry and a large run can be achieved. From this viewpoint, this total number is more preferably not less than 500 thousand and particularly preferably not less than one million. With the golf ball 2 in which this total number is not greater than 10 million, the minute projections 18 do not excessively reduce lift force. With the golf ball 2, a large carry can be achieved. From this viewpoint, this total number is more preferably not greater than 7 million and particularly preferably not greater than 5 million.

In the golf ball 2, the average depth Fav of the dimples 12 and the average height Hav of the minute projections 18 satisfy the following mathematical formula (1).

$$Hav/Fav \geq 0.050 \quad (1)$$

In other words, the ratio (Hav/Fav) of the average height Hav to the average depth Fav is not less than 0.050. With the golf ball 2 in which the ratio (Hav/Fav) is not less than 0.050, the minute projections 18 reduce lift force and drag. With the golf ball 2, a large carry and a large run can be achieved. From this viewpoint, the ratio (Hav/Fav) is more preferably not less than 0.055 and particularly preferably not less than 0.060. The ratio (Hav/Fav) is preferably not greater than 0.100. With the golf ball 2 in which the ratio (Hav/Fav) is not greater than 0.100, the minute projections 18 do not excessively reduce lift force. With the golf ball 2, a large carry can be achieved. From this viewpoint, the ratio (Hav/Fav) is more preferably not greater than 0.095 and particularly preferably not greater than 0.090.

Preferably, in the golf ball 2, the occupation ratio M and the average value Pav of the pitches P satisfy the following mathematical formula (2).

$$M/Pav > 0.3 \quad (2)$$

In other words, the ratio (M/Pav) of the occupation ratio M to the average value Pav is greater than 0.3. With the golf ball 2 in which the ratio (M/Pav) is greater than 0.3, the minute projections 18 reduce lift force and drag. With the golf ball 2, a large carry and a large run can be achieved. From this viewpoint, the ratio (M/Pav) is more preferably not less than 0.5 and particularly preferably not less than 0.7. The ratio (M/Pav) is preferably not greater than 10.0. With the golf ball 2 in which the ratio (M/Pav) is not greater than 10.0, the minute projections 18 do not excessively reduce lift force. With the golf ball 2, a large carry can be achieved. Furthermore, it is easy to produce a mold for the golf ball 2 in which the ratio (M/Pav) is not greater than 10.0. From these viewpoints, the ratio (M/Pav) is more preferably not greater than 9.0 and particularly preferably not greater than 8.0.

Preferably, the average value Pav of the pitches P and the average value Lav of the distances L satisfy the following mathematical formula (3).

$$Lav/Pav < 0.9 \quad (3)$$

In other words, the ratio (Lav/Pav) of the average value Lav to the average value Pav is less than 0.9. With the golf ball 2 in which the ratio (Lav/Pav) is less than 0.9, the minute projections 18 reduce lift force and drag. With the golf ball 2, a large carry and a large run can be achieved. From this viewpoint, the ratio (Lav/Pav) is more preferably not greater than 0.8 and particularly preferably not greater than 0.7. The ratio (Lav/Pav) is preferably not less than 0.1. With the golf ball 2 in which the ratio (Lav/Pav) is not less than 0.1, the minute projections 18 do not excessively reduce lift force. With the golf ball 2, a large carry can be achieved. From these viewpoints, the ratio (Lav/Pav) is more preferably not less than 0.2 and particularly preferably not less than 0.3.

As described above, each minute projection 18 includes the projection portion 22 of the main body 10 and the paint layer 20 (see FIG. 6). Therefore, even when the paint layer 20 is separated from the main body 10 due to the golf ball 2 being hit by a golf club or colliding against the ground, the shapes of the minute projections 18 are substantially maintained. Accordingly, the aerodynamic characteristic is substantially maintained. A special paint is not needed for forming the minute projections 18. The golf ball 2 can be easily produced.

As described above, the minute projections 18 are formed on the surfaces of the dimples 12 and also on the surface of the land 14 (see FIG. 4). Therefore, the golf ball 2 has a very excellent aerodynamic characteristic. The minute projections 18 may be formed only on the surfaces of the dimples 12. The minute projections 18 may be formed only on the surface of the land 14.

The shape of each minute projection 18 shown in FIGS. 4 and 5 is substantially a circular column. The golf ball 2 may have minute projections 18 having another shape. Examples of the other shape include a prism, a truncated pyramid, a truncated cone, a pyramid, and a cone. The shape of each minute projection 18 may be a part of a sphere. Each minute projection 18 may have a shape obtained by combining a plurality of solids. The golf ball 2 may have a plurality of types of minute projections 18 having shapes different from each other. The golf ball 2 may have a plurality of types of minute projections 18 having sizes different from each other.

The projection portions 22 of the main body 10 are formed simultaneously with formation of the main body 10. For the formation, a mold is used. The cavity face of the mold has a large number of minute recesses. Each recess has a shape that is substantially the inverted shape of the projection portion 22.

The mold can be obtained from a master mold having dimples. The shapes of the dimples are transferred onto the mold, whereby pimples are formed on the mold. Minute recesses are formed on the mold by cutting, laser radiation processing, or the like. On a golf ball 2 obtained from the mold, dimples 12 are formed by the shapes of the pimples being transferred thereonto, and minute projections 18 are formed by the shapes of the minute recesses being transferred thereonto.

A mold having pimples may be produced directly through cutting, not through transfer from a master mold. In this case as well, minute recesses are formed on the mold by cutting, laser radiation processing, or the like.

EXAMPLES

Example 1

A rubber composition was obtained by kneading 100 parts by weight of a high-cis polybutadiene (trade name "BR-730", manufactured by JSR Corporation), 27.4 parts by weight of zinc diacrylate, 5 parts by weight of zinc oxide, an appropriate amount of barium sulfate, 0.5 parts by weight of diphenyl disulfide, and 0.9 parts by weight of dicumyl peroxide. This rubber composition was placed into a mold including upper and lower mold halves each having a hemispherical cavity, and heated at 160° C. for 20 minutes to obtain a core with a diameter of 38.20 mm. The amount of barium sulfate was adjusted such that a core having a predetermined weight was obtained.

A resin composition was obtained by kneading 26 parts by weight of an ionomer resin (trade name "Himilan AM7337", manufactured by Du Pont-MITSUI POLYCHEMICALS Co., Ltd.), 26 parts by weight of another ionomer resin (trade name "Himilan AM7329", manufactured by Du Pont-MITSUI POLYCHEMICALS Co., Ltd.), 48 parts by weight of a styrene block-containing thermoplastic elastomer (trade name "Rabalon T3221C", manufactured by Mitsubishi Chemical Corporation), 4 parts by weight of titanium dioxide (A220), and 0.2 parts by weight of a light stabilizer (trade name "JF-90", manufactured by Johoku Chemical Co., Ltd.) with a twin-screw kneading extruder. The core was covered with this resin composition by injection molding to form a mid layer. The thickness of the mid layer was 1.00 mm.

A resin composition was obtained by kneading 47 parts by weight of an ionomer resin (trade name "Himilan 1555", manufactured by Du Pont-MITSUI POLYCHEMICALS Co., Ltd.), 46 parts by weight of another ionomer resin (trade name "Himilan 1557", manufactured by Du Pont-MITSUI POLYCHEMICALS Co., Ltd.), 7 parts by weight of a styrene block-containing thermoplastic elastomer (the aforementioned "Rabalon T3221C"), 4 parts by weight of titanium dioxide (A220), and 0.2 parts by weight of a light stabilizer (the aforementioned "JF-90") with a twin-screw kneading extruder. The sphere consisting of the core and the mid layer was placed into a final mold having a large number of pimples and minute recesses on its cavity face. The mid layer was covered with the resin composition by injection molding to form a cover. The thickness of the cover was 1.25 mm. Dimples having a shape that is the inverted shape of the pimples were formed on the cover. Furthermore, minute projection portions having a shape that is the inverted shape of the minute recesses were formed on the cover.

A clear paint including a two-component curing type polyurethane as a base material was applied to this cover to obtain a golf ball of Example 1 with a diameter of about 42.7 mm and a weight of about 45.6 g. The golf ball has a large number of minute projections on the surface thereof. The specifications of these minute projections are shown in Table 1 below.

Examples 2 to 17 and Comparative Examples 1 to 7

Golf balls of Examples 2 to 17 and Comparative Examples 1 to 7 were obtained in the same manner as Example 1, except the final mold was changed and dimples and minute projections having specifications shown in Tables 2 to 7 below were formed. The specifications of the dimples are shown in Table 1 below. The golf balls according to Comparative Examples 1, 2, 4, and 6 do not have any minute projections.

[Flight Test]

A driver (trade name "XXIO", manufactured by DUNLOP SPORTS CO. LTD., shaft hardness: R, loft angle)10.5° was attached to a swing machine manufactured by Golf Laboratories, Inc. A golf ball was hit under a condition of a head speed of 40 m/sec, and the carry and the run were measured. During the test, the weather was almost windless. The average value of data obtained by 20 measurements is shown in Tables 2 to 7 below.

TABLE 1

Specifications of Dimples

| | Type | Number | Diameter (mm) | Depth of spherical surface (mm) | Curvature radius (mm) | Volume ($mm^3$) |
|---|---|---|---|---|---|---|
| i | A | 30 | 4.40 | 0.239 | 19.4 | 1.816 |
| | B | 140 | 4.30 | 0.234 | 18.6 | 1.697 |
| | C | 90 | 4.20 | 0.229 | 17.7 | 1.585 |
| | D | 40 | 3.95 | 0.212 | 16.3 | 1.297 |
| | E | 40 | 3.50 | 0.187 | 13.4 | 0.900 |
| ii | A | 30 | 4.40 | 0.254 | 17.4 | 1.931 |
| | B | 140 | 4.30 | 0.249 | 16.6 | 1.807 |
| | C | 90 | 4.20 | 0.244 | 15.8 | 1.689 |
| | D | 40 | 3.95 | 0.227 | 14.5 | 1.390 |
| | E | 40 | 3.50 | 0.202 | 11.8 | 0.972 |
| iii | A | 30 | 4.40 | 0.269 | 15.7 | 2.045 |
| | B | 140 | 4.30 | 0.264 | 15.0 | 1.916 |
| | C | 90 | 4.20 | 0.259 | 14.3 | 1.793 |
| | D | 40 | 3.95 | 0.242 | 13.1 | 1.482 |
| | E | 40 | 3.50 | 0.217 | 10.6 | 1.045 |
| iv | A | 168 | 4.50 | 0.275 | 16.3 | 2.189 |
| | B | 168 | 3.40 | 0.214 | 10.0 | 0.972 |

TABLE 2

Results of Evaluation

| | Comp. Example 1 | Example 1 | Example 2 | Example 3 |
|---|---|---|---|---|
| Dimple | i | i | i | i |
| Front view | FIG. 2 | FIG. 2 | FIG. 2 | FIG. 2 |
| Plan view | FIG. 3 | FIG. 3 | FIG. 3 | FIG. 3 |
| Total volume | 522.6 | 522.6 | 522.6 | 522.6 |
| Fav (μm) | 225 | 225 | 225 | 225 |
| Hav (μm) | — | 12 | 18 | 24 |
| Hav/Fav | — | 0.053 | 0.080 | 0.107 |
| M (%) | 80.5 | 80.5 | 80.5 | 80.5 |
| Pav (μm) | — | 50 | 50 | 50 |
| M/Pav | — | 1.6 | 1.6 | 1.6 |
| Qav ($\mu m^2$) | — | 491 | 491 | 491 |
| Lav (μm) | — | 25 | 25 | 25 |
| L/P | — | 0.50 | 0.50 | 0.50 |
| Carry (m) | 185 | 186 | 186 | 185 |
| Run (m) | 15 | 17 | 18 | 17 |
| Total (m) | 200 | 203 | 204 | 202 |

TABLE 3

Results of Evaluation

| | Example 4 | Example 5 | Example 6 | Example 7 | Example 8 |
|---|---|---|---|---|---|
| Dimple | ii | ii | ii | ii | ii |
| Front view | FIG. 2 | FIG. 2 | FIG. 2 | FIG. 2 | FIG. 2 |
| Plan view | FIG. 3 | FIG. 3 | FIG. 3 | FIG. 3 | FIG. 3 |
| Total volume | 557.3 | 557.3 | 557.3 | 557.3 | 557.3 |
| Fav (μm) | 240 | 240 | 240 | 240 | 240 |
| Hav (μm) | 12 | 12 | 12 | 12 | 12 |
| Hav/Fav | 0.050 | 0.050 | 0.050 | 0.050 | 0.050 |
| M (%) | 80.5 | 80.5 | 80.5 | 80.5 | 80.5 |
| Pav (μm) | 10 | 30 | 30 | 30 | 30 |
| M/Pav | 8.1 | 2.7 | 2.7 | 2.7 | 2.7 |
| Qav ($\mu m^2$) | 20 | 177 | 314 | 79 | 14 |
| Lav (μm) | 5 | 15 | 10 | 20 | 26 |
| L/P | 0.50 | 0.50 | 0.33 | 0.67 | 0.86 |
| Carry (m) | 183 | 184 | 185 | 184 | 184 |
| Run (m) | 20 | 22 | 21 | 21 | 20 |
| Total (m) | 203 | 206 | 206 | 205 | 204 |

TABLE 4

Results of Evaluation

| | Example 9 | Example 10 | Example 11 | Comp. Example 2 |
|---|---|---|---|---|
| Dimple | ii | ii | ii | ii |
| Front view | FIG. 2 | FIG. 2 | FIG. 2 | FIG. 2 |
| Plan view | FIG. 3 | FIG. 3 | FIG. 3 | FIG. 3 |
| Total volume | 557.3 | 557.3 | 557.3 | 557.3 |
| Fav (μm) | 240 | 240 | 240 | 240 |
| Hav (μm) | 12 | 12 | 12 | — |
| Hav/Fav | 0.050 | 0.050 | 0.050 | — |
| M (%) | 80.5 | 80.5 | 80.5 | 80.5 |
| Pav (μm) | 50 | 50 | 270 | — |
| M/Pav | 1.6 | 1.6 | 0.3 | — |
| Qav ($\mu m^2$) | 491 | 20 | 14314 | — |
| Lav (μm) | 25 | 45 | 135 | — |
| L/P | 0.50 | 0.90 | 0.50 | — |
| Carry (m) | 183 | 182 | 182 | 183 |
| Run (m) | 21 | 20 | 21 | 18 |
| Total (m) | 204 | 202 | 203 | 201 |

TABLE 5

Results of Evaluation

| | Comp. Example 3 | Example 12 | Example 13 | Example 14 |
|---|---|---|---|---|
| Dimple | ii | ii | ii | ii |
| Front view | FIG. 2 | FIG. 2 | FIG. 2 | FIG. 2 |
| Plan view | FIG. 3 | FIG. 3 | FIG. 3 | FIG. 3 |
| Total volume | 557.3 | 557.3 | 557.3 | 557.3 |
| Fav (μm) | 240 | 240 | 240 | 240 |
| Hav (μm) | 10 | 16 | 22 | 25 |
| Hav/Fav | 0.042 | 0.067 | 0.092 | 0.104 |
| M (%) | 80.5 | 80.5 | 80.5 | 80.5 |
| Pav (μm) | 50 | 50 | 50 | 50 |
| M/Pav | 1.6 | 1.6 | 1.6 | 1.6 |
| Qav ($\mu m^2$) | 491 | 491 | 491 | 491 |
| Lav (μm) | 25 | 25 | 25 | 25 |
| L/P | 0.50 | 0.50 | 0.50 | 0.50 |
| Carry (m) | 182 | 184 | 182 | 182 |
| Run (m) | 19 | 21 | 22 | 20 |
| Total (m) | 201 | 205 | 204 | 202 |

TABLE 6

Results of Evaluation

| | Comp. Example 4 | Comp. Example 5 | Example 15 |
|---|---|---|---|
| Dimple | iii | iii | iii |
| Front view | FIG. 2 | FIG. 2 | FIG. 2 |
| Plan view | FIG. 3 | FIG. 3 | FIG. 3 |
| Total volume | 592.1 | 592.1 | 592.1 |
| Fav (μm) | 255 | 255 | 255 |
| Hav (μm) | — | 12 | 14 |
| Hav/Fav | — | 0.047 | 0.055 |
| M (%) | 80.5 | 80.5 | 80.5 |
| Pav (μm) | — | 50 | 50 |
| M/Pav | — | 1.6 | 1.6 |
| Qav ($\mu m^2$) | — | 491 | 491 |
| Lav (μm) | — | 25 | 25 |
| L/P | — | 0.50 | 0.50 |
| Carry (m) | 180 | 179 | 181 |
| Run (m) | 20 | 21 | 22 |
| Total (m) | 200 | 200 | 203 |

TABLE 7

Results of Evaluation

Figure 8:
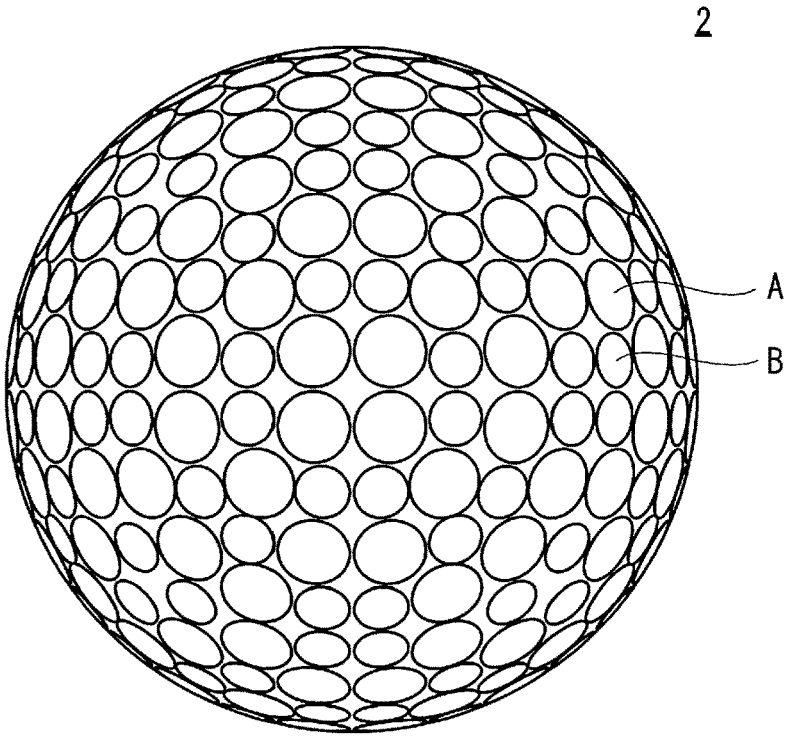
FIG. 8 is a front view of a golf ball according to Example 14 of the present invention.
Figure 9:
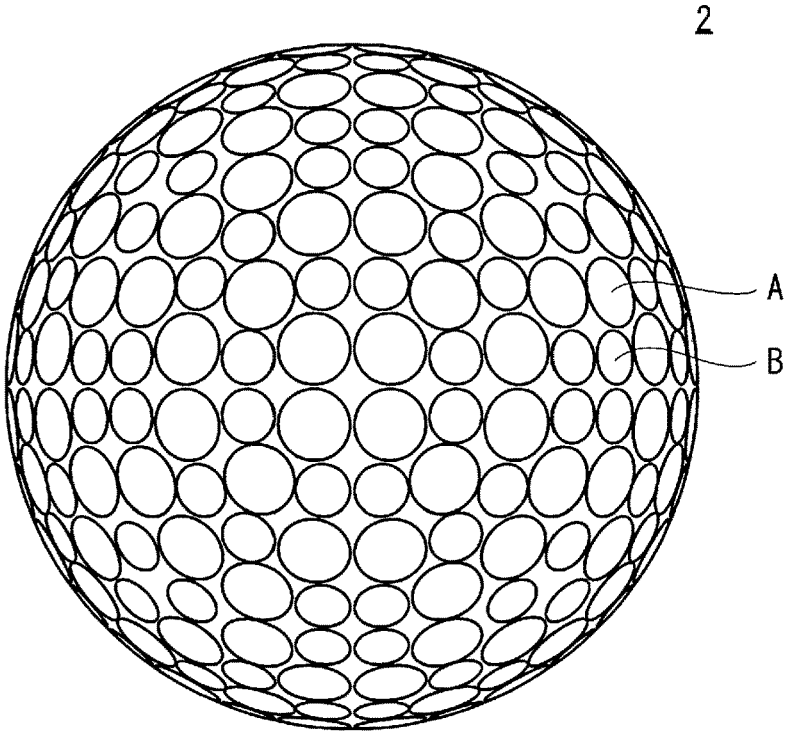
FIG. 9 is a plan view of the golf ball in FIG. 8.

| | Comp. Example 6 | Comp. Example 7 | Example 16 | Example 17 |
|---|---|---|---|---|
| Dimple | iv | iv | iv | iv |
| Front view | FIG. 8 | FIG. 8 | FIG. 8 | FIG. 8 |
| Plan view | FIG. 9 | FIG. 9 | FIG. 9 | FIG. 9 |
| Total volume | 531.1 | 531.1 | 531.1 | 531.1 |
| Fav (μm) | 244 | 244 | 244 | 244 |
| Hav (μm) | — | 8 | 14 | 14 |
| Hav/Fav | — | 0.033 | 0.057 | 0.057 |
| M (%) | 73 | 73 | 73 | 73 |
| Pav (μm) | — | 50 | 50 | 270 |
| M/Pav | — | 1.5 | 1.5 | 0.3 |
| Qav ($\mu m^2$) | — | 491 | 491 | 14314 |
| Lav (μm) | — | 25 | 25 | 135 |
| L/P | — | 0.50 | 0.50 | 0.50 |
| Carry (m) | 182 | 181 | 183 | 182 |
| Run (m) | 17 | 18 | 20 | 20 |
| Total (m) | 199 | 199 | 203 | 202 |

As shown in Tables 2 to 7, the golf ball of each Example has excellent flight performance upon a shot with a driver. From the evaluation results, advantages of the present invention are clear.

The aforementioned minute projections are applicable to golf balls having various structures such as a one-piece golf ball, a two-piece golf ball, a four-piece golf ball, a five-piece golf ball, a six-piece golf ball, a thread-wound golf ball, and the like in addition to a three-piece golf ball. The above descriptions are merely illustrative examples, and various modifications can be made without departing from the principles of the present invention.

What is claimed is:

1. A golf ball having a plurality of dimples and a land, wherein the golf ball includes a main body and a paint layer positioned outside the main body, wherein the golf ball further has a large number of minute projections formed on surfaces of the dimples and/or the land, wherein an average depth Fav of the dimples and an average height Hav of the minute projections satisfy the following mathematical formula (1):

$$Hav/Fav>0.050 \quad (1),$$

wherein the main body has a core, at least one cover positioned outside the core, and main body projection portions formed on the cover, wherein each minute projection is defined by one of said main body projection portions and projects outward in the radial direction such that each minute projection has a shape in which a surface shape of the main body is reflected, wherein a diameter of a sphere of the golf ball including the core and the cover is not less than 42.70 mm, wherein an average value Pav of pitches P each between a center of gravity of one minute projection and a center of gravity of another minute projection adjacent to the one minute projection is not greater than 200 μm, and a total number of the minute projections is not less than 100,000.

2. The golf ball according to claim 1, wherein a ratio M (%) of a sum of areas of all the dimples relative to a surface area of a phantom sphere of the golf ball and the average value Pav (μm) of pitches P each between the center of gravity of the one minute projection and the center of gravity of the another minute projection adjacent to the one minute projection satisfy the following mathematical formula (2):

$$M/Pav>0.3 \quad (2).$$

3. The golf ball according to claim 1, wherein an average value of distances L is defined as Lav, wherein each of said P and L is between the center of gravity of one minute projection and the center of gravity of another minute projection adjacent to the one minute projection, and wherein Pav and Lav satisfy the following mathematical formula (3):

$$Lav/Pav<0.9 \quad (3).$$

4. The golf ball according to claim 1, wherein the golf ball has a plurality of rows in each of which a plurality of the minute projections are aligned at equal pitches.

5. The golf ball according to claim 1, wherein the average depth Fav and the average height Hav satisfy the following mathematical formula:

$$0.092>Hav/Fav>0.050.$$

6. The golf ball according to claim 1, wherein the average height Hav is not greater than 50 μm.

* * * * *